United States Patent [19]

Powell

[11] Patent Number: 4,544,877

[45] Date of Patent: Oct. 1, 1985

[54] POWER CONDITIONING SYSTEM AND APPARATUS

[75] Inventor: Jeffrey M. Powell, Galena, Ohio

[73] Assignee: Liebert Corporation, Columbus, Ohio

[21] Appl. No.: 510,560

[22] Filed: Jul. 5, 1983

[51] Int. Cl.[4] ..... G05F 3/06

[52] U.S. Cl. ..... 323/308; 323/310

[58] Field of Search ..... 363/44, 45, 46, 47, 363/48, 64, 75, 90, 91, 164, 171, 172; 323/214, 215, 306, 307, 308, 361, 362, 232, 310; 333/177, 180; 307/7; 336/165, 178, 214, 215, 233, 234, 212, 213, 217

[56] References Cited

U.S. PATENT DOCUMENTS

| | | | |
|---|---|---|---|
| 1,353,711 | 9/1920 | Bergman | 336/165 X |
| 3,243,651 | 3/1966 | Feinberg et al. | 336/165 |
| 4,305,033 | 12/1981 | Powell | 323/306 |

FOREIGN PATENT DOCUMENTS

| | | | |
|---|---|---|---|
| 448341 | 12/1934 | United Kingdom | 363/171 |

*Primary Examiner*—Peter S. Wong
*Assistant Examiner*—Judson H. Jones
*Attorney, Agent, or Firm*—Mueller and Smith

[57] ABSTRACT

Power conditioning apparatus particularly suited for computer facilities and including non-linear input chokes connectable with line power. These chokes are structured having a center leg configured to define a varying gap having a narrowest flux transfer region located centrally with respect to a surrounding shell structure. The gap configuration expands uniformly outwardly from this narrowest region. The outputs of the input chokes are serially, magnetically coupled through primary windings to pulse saturable reactors of a synthesizing network which includes a capacitor bank and operates to synthesize a sinewave output. The capacitance values of the capacitor bank are selectively distributed between the primary, isolation windings and the pulse saturable secondary or regulator components of the synthesizer network to achieve important improvements in system efficiency.

32 Claims, 11 Drawing Figures

10
12
14
15
16
18
20
21
22
24
25
26
28
29
30
32
33
34
36
37
38
40
41
42
44
48
49
50
52
54
55
56
57
58
60
61
62
66
68
69
70
C13
C23
C31
C32
C33
C41
C42
C43
C11
C12
C21
C22
TX1
TX2
TX3
TX4
TX5
TX6
TX7
TX8
TX9
TX10
TX11
TX12
TX13
TX14
TX15
TX16
TX1'
TX2'
TX3'
TX4'
TX5'
TX6'

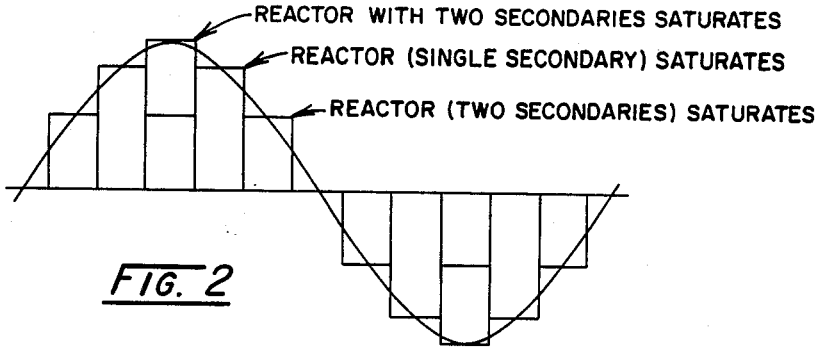
FIG. 2
FIG. 3A
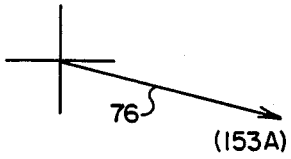
INPUT
(PRIM.)
FIG. 3B
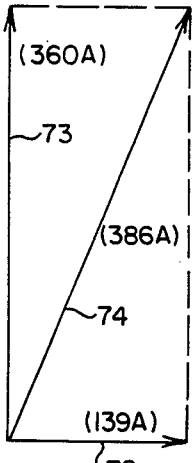
OUTPUT
(SEC.)
FIG. 4A
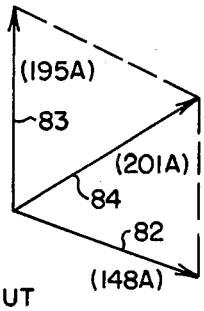
INPUT
(PRIM.)
FIG. 4B
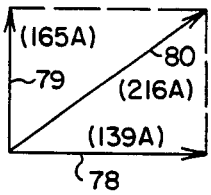
OUTPUT
(SEC.)

POWER CONDITIONING SYSTEM AND APPARATUS

BACKGROUND

Data processing installations of moderate to major capability generally are situated within the internal regions of buildings which have been designed to provide not only rigidly controlled environments through dedicated air-conditioning systems and the like, but also accurately regulated and reliable supplies of power. In the latter regard, line power now available from utilities for use by the computer facilities has been observed to be deteriorating in quality to the extent that, for the most part, it has become unacceptable for direct application to data processing systems. Vagaries in line power stem from many causes but are categorized principally as line transient and out-of-specification voltage. Line transient may develop from a variety of perturbations, for example they may be generated due to short circuits along the distribution lines, utility primary switching, radio frequency interference, lightning or power factor corrections manifested as oscillatory ringing transients. Under-voltage or over-voltage phenomena generally occur in conjunction with regulator activity, load changing on the power line, short circuits and lightning.

When imposed upon computer operations, line transients are characterized by data errors, unprogrammed jumps and software/data file alterations. Momentary under-and over-voltage phenomena can result in automatic computer power down and, in extreme cases, damage to the equipment.

To overcome the aberrations of line power supplies, a variety of power conditioning devices have been installed within the computer room facility. For example, uninterruptable power supplies (UPS) using a battery charger, batteries, an inverter, and static switch arrangement may be installed to evoke waveform recreation, or motor generators may be provided. In some approaches, systems which modify, but do not recreate, waveforms such as voltage regulators or spike suppressors are utilized. These latter systems basically are ineffective in the treatment of all line conditions which may be encountered. Regulators, for example, incorporate feedback loops, the performance of which is too slow to render the devices effective in computer applications. UPS systems when configured for reliable performance, are effective but heretofore have been found to represent a significant capital investment.

Recently, a polyphase, ferroresonant voltage stabilizer or synthesizer has been successfully introduced to the marketplace. In their elementary form, such synthesizers comprise a regulator which is fashioned as a nonlinear saturable transformer arrangement in parallel with a capacitor assemblage which is supplied from the line source through an input inductor. The saturable transformer components and capacitors form a ferroresonant circuit wherein the reactive components operate beyond the knee of a conventional magnetization curve. Described in U.S. Pat. No. 4,305,033 by Jeffrey M. Powell, the noted ferroresonant voltage stabilizer or synthesizer enjoys advantages of economic construction and efficient performance while remaining immune from certain unsatisfactory characteristics related to stability and reliability which previously had been associated with resonating circuits. Literature concerning this ferroresonant approach to power conditioning has been generated as is evidenced by the following papers:

I. Practical Equivalent Circuits for Electromagnetic Devices by Biega, The Electronic Engineer, June, 1967.

II. Static-Magnetic Regulators—A Cure for Power Line "Spikes" by Kimball, Electronic Products, reprinted by Thomas and Skinner, Inc., Bulletin No. L-552.

III. A New Feedback-Controlled Ferroresonant Regulator Employing a Unique Magnetic Component, Hart, IEEE Transaction on Magnetics, Vol. MAG-7 No. 3, September, 1971, pp 571–574.

IV. A Feedback-Controlled Ferroresonant Voltage Regulator, Kakalec, IEEE Transactions on Magnetics, Vol. Mag-6, No. 1, March, 1970.

V. Design Techniques for Ferroresonant Transformers by Workman, Jr. reprinted by Thomas and Skinner, Inc., Bulletin No. L-551.

VI. Comparison of Inverter Circuits for Use in Fixed Frequency Uninterruptable Power Supplies by Bratton and Powell, Instrument Society of America, ISA-76, International Conference and Exhibit, October 11–14, 1976.

For any approach taken with respect to the conditioning of line power for computer room purposes, power losses will be experienced which are manifested in the form of heat which is released to the computer room environment. As a consequence, the air-conditioning system dedicated to that computer room environment must not only accommodate the requirements of the computer system, but also the loss generated heat occasioned by power consumption. In assessing anticipated costs, the computer facility owner also must evaluate the cost associated with the loss in power due to the efficiency level of the power conditioning system and the corresponding cost occasioned by the power required to remove heat generated in consequence of lower efficiences. For principal computer room installations, these costs can be significant.

Experience has shown that the above-discussed ferroresonant power conditioner devices exhibit efficiencies of about 91% which are considered to be excellent. Correspondingly, UPS systems have been observed to exhibit efficiencies of about 85%. Where for example, 100 KW computer facility installations are involved, the efficiency associated with a UPS system may impose power costs of about $10,000.00 for a year's operation at about six cents per kilowatt hour. Of course, in regions of higher rates, for example, about 15 cents per kilowatt hour, such power cost will amount to about $23,000.00. It follows that improvements in efficiency of, for example, a single percentage point, will represent significant cost savings to the computer facility operator.

Another aspect of efficiency level performance resides in the costs associated with the fabrication of power conditioning equipment. For example, where higher levels of efficiency are achieved in inductive device performance or in conjunction with reactor operation, then the components themselves may be fabricated at lower and less costly scale.

SUMMARY

The present invention is addressed to power conditioning systems and apparatus which achieve important improvements in operational efficiencies. These improvements in efficiencies not only result in advantageously lowered power demands but also in a reduction in the sizes and costs of components which form the conditioning systems.

In one aspect, the invention presents a unique arrangement of the capacitor components or banks effecting the oscillatory saturation of regulator reactor components wherein a significant reduction of processed KVA energy as is experienced by the regulators in providing a given power throughput is realized. By associating the capacitance values of these capacitor components between the primary, (isolation windings) and the secondary (output windings) of the pulse saturable reactors, or regulator components, thereof, in accordance with a unique relationship or ratio, important improvements in operational efficiencies are developed.

As another aspect and feature of the invention, an input inductor or line choke is provided which achieves unique operational efficiencies through the incorporation therein of an impedance deriving gapped core serving as a flux director or "chute". With the arrangement, the center leg of the line choke is configured to define a varying gap configuration having a narrowest flux transfer region located substantially centrally with respect to the adjacent wall of a surrounding shell structure serving the conventional function of a return path. The gap configuration then expands uniformly outwardly from this narrowest region to provide for higher impedance flux transfer without the substantial development of losses due to edge-to-plane fringing phenomena.

By combining the efficiency improvements associated with the select division of capacitance values between the primary and secondary of the ferroresonant reactor components and by additionally providing for the improved efficiency of the input inductors, a power conditioning system is made available with important efficiency improvements, for example, to levels approaching 95%. Further, because of this improved efficiency, important components of the system may be fabricated in accordance with a cost reducing lower scale. In the latter regard, the input inductors or line chokes may be reduced as much as 40% in terms of material requirements, while the size of the regulators utilized to provide ferroresonant sinusoidal output may be reduced in terms of material to an extent of about 30%. Such reductions in scale may be observed to impact on conditioner system fabrication costs to the extent of reducing such costs by a factor of about 25%.

Another object and feature of the invention is to provide apparatus for use with an a.c. source of variable voltage level and waveshape having a given frequency for providing a regulated a.c. output to a load. The apparatus includes an input choke having a non-linear impedance characteristic connectable with the a.c. source and which derives an energy input which is characterized in being substantially immune from the variable waveshape and voltage level. A primary winding is coupled with the input choke for purposes of isolated energy transfer, and where desired, for step down purposes. A regulator is provided with the apparatus which includes a saturable reactor having a secondary winding arrangement which is magnetically coupled in energy transfer relationship with the primary winding noted above. A first capacitor bank of first predetermined capacitance value is coupled with the secondary winding arrangement and a second capacitor bank of second predetermined capacitance value is coupled with the primary winding arrangement. The first and second capacitor banks serve to provide the oscillatory saturation of the reactor structure at the given frequency and the first and second capacitance values are selected in accordance with a ratio which minimizes the energy appearing across the saturable reactor arrangement in the course of the oscillatory saturation thereof. When computed from an ideal standpoint, the ratio of the above-noted first capacitor value to the above-noted second capacitor value may be selected as 35/65. However, important efficiencies in improvement may be realized by the location of capacitance for carrying out oscillation at the primary winding location alone.

A further object of the invention is to provide an input inductor for selectively treating a line source of power wherein an outer, flux permeable shell is provided which is formed as a plurality of substantially flat, first flux directing components arranged in face-to-face parallel adjacency to define an outwardly disposed flux permeable path surmounting a central window region. Within the window region there is positioned a conducting coil which is connected between the source and regulator. A center leg which is formed as a plurality of substantially flat second flux directing components extends within the coil to oppositely disposed edge regions defining a varying gap with correspondingly opposite adjacent edges of the outer flux permeable shell. The gap is arranged having a narrowest extent for flux transfer substantially centrally positioned within the window and provides a progressively increasing flux travel path outwardly therefrom. In a preferred arrangement, the center leg edge regions are configured having a centrally disposed apex portion for deriving the gap of narrowest extent and are configured having substantially linear sloping edge portions extending therefrom to define the remainder of the flux transfer gap.

Another object of the invention is to provide a system for conditioning an a.c. source of power having a given frequency so as to provide a regulated a.c. output to a load. The system includes an input inductor which incorporates a flux permeable outer shell structured as a plurality of substantially flat first flux directing components arranged in stacked relationship to form a flux permeable path surmounting a window or cavity having oppositely disposed first and second walls. A center leg structured as a plurality of substantially flat second flux directing components is positioned within the cavity and is provided having a first edge region extending toward the first wall and which defines a varying gap with such wall, the gap having a narrowest flux transfer portion substantially centrally located with respect to the first wall and progressively increasing in extent outwardly from the narrowest flux transfer portion. A coil connectable between the a.c. source and regulator primary is disposed about the center leg for deriving with the shell and the center leg a treated energy input. A primary winding is coupled with the coil to receive the treated energy input for effecting energy transfer, isolation and, where desired, step down functions. A regulator is incorporated with the system which includes a saturable reactor having a secondary winding inductively coupled in energy transfer with the primary winding arrangement. A first capacitor arrangement of first predetermined capacitance value is coupled with the secondary winding and a second capacitor arrangement of second predetermined capacitance value is coupled with the primary winding arrangement. These first and second capacitor networks serve to effect the oscillatory saturation of the reactor at the driven frequency and the ratio of the first to the second capacitance values is selected to minimize the energy appearing across the saturable reactor in the course of the oscillatory saturation thereof.

Other objects of the invention will, in part, be obvious and will, in part, appear hereinafter. The invention, accordingly, comprises the system and apparatus possessing the construction, combination of elements, and arrangement of parts which are exemplified in the following detailed description.

For a fuller understanding of the nature and objects of the invention, reference should be had to the following detailed description taken in connection with the accompanying drawings.

BRIEF DESCRIPTION OF THE DRAWINGS

FIG. 2 is a sinewave showing the synthesis thereof by pulse positioning in accordance with the operation of the circuit of FIG. 1;

FIGS. 3A and 3B are vector diagrams illustrating exemplary current relationships within ferroresonant devices of the prior art;

FIGS. 4A and 4B are vector diagrams illustrating the improvement in energy utilization in carrying out power conditioning in accordance with the teachings of the instant invention;

DETAILED DESCRIPTION

Figure 1:
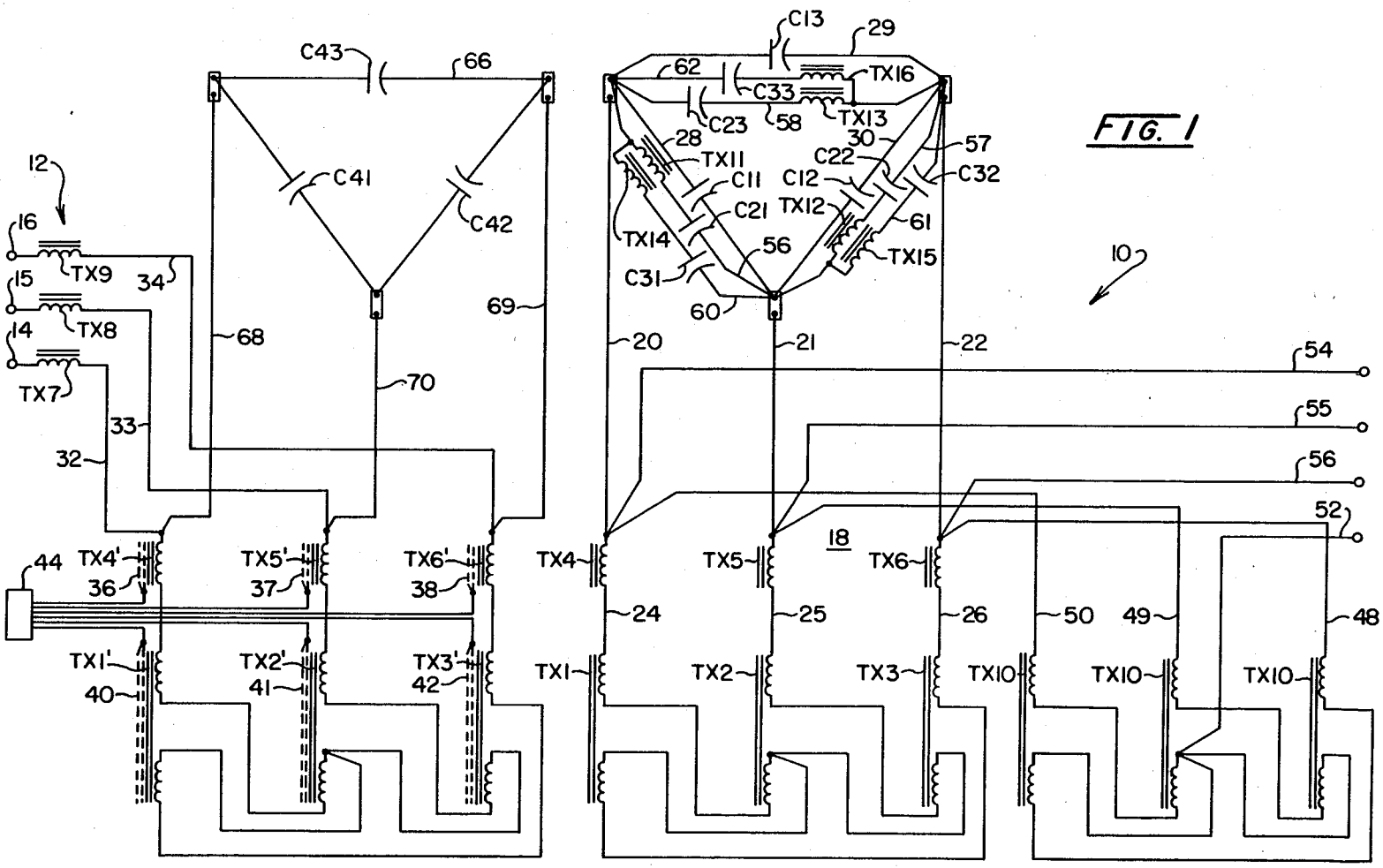
FIG. 1 is a schematic diagram of a circuit incorporating features of the invention.

Referring to FIG. 1, a schematic diagram showing the components of a polyphase ferroresonant voltage stabilizer or power conditioning apparatus is represented generally at 10. The structures embodying the circuit represented by the drawing are particularly suited in consequence of their attributes of reliability and quality of regulation for use in conjunction with computer facilities. As indicated hereinabove, such facilities generally are located within a building and, over the recent past, have been formed of components which are somewhat moveable so as to afford a flexibility of computer system design. Of course, being located within the internal environment of a building, any losses resulting from their operation are manifested in the form of heat which these same centrally located computer facilities generally must be called upon to remove. Further, because as the computer facilities become large in extent, the cost of their operation in terms of power consumption becomes significant, the level of efficiency of such installations assumes concomitant importance to those charged with overall computer facility design. The schematic circuit represented generally at 10 in FIG. 1 will be observed to be similar to that described in the above-referenced U.S. Pat. No. 4,305,033 but incorporates circuit features which permit important improvements in efficiency of performance which, as indicated above, translate to important cost savings both in terms of heat removal within the computer facility as well as in a lowering of both power requirements and the scale required of the individual components within the circuit.

FIG. 1 reveals an input side of the power conditioning apparatus at 12 having three phase input lines 14–16 which are coupled to a conventional utility derived polyphase power supply and which represent the line input to the regulating features of the system and apparatus 10. Lines 14–16 extend, in turn, to three respective input chokes of inductors TX7, TX8, and TX9. These input chokes preferably are configured having a varying gap core structure which minimizes losses occasioned by unaccommodated fringing and advantageously permits the assertion of a substantial impedance at levels of load extending from low values to full load conditions while effecting diminishing impedance to the a.c. source input for overload conditions. As such the input chokes have a capability to effect the conveyance of transient load start-up currents while providing stable operation under varying normal loading conditions. More conventionally, the input inductors TX7–TX9 perform as a buffer at the source of power represented at lines 14–16 which has a given frequency and a unique sinewave shape and associated voltage. Input inductors TX7–TX9 transfer the energy of that power source into the synthesizing components of apparatus 10 without transferring thereinto the waveshape associated with the power source at lines 14–16 or the voltage characteristics thereof. Line inductors or chokes as at TX7–TX9 have been described as acting as a high impedance, or spongy connection between the power line input and the regulator functions of system 10. High frequency power line phenomena such as lightning and switching transient, encounter even higher impedance due to the natural frequency selective characteristics of inductors or chokes. Generally, the regulatory features of the system and apparatus at 10 require, from the line source, energy within a usable band of voltage and having a frequency reference (usually 60 Hz), the regulator then functions following the frequency evoked at the line power source.

The regulator or synthesizing network of circuit 10, as represented generally at 18, may be observed to be comprised of six saturable reactors TX1–TX6 which, in accordance with conventional practice, operate in concert with a capacitor bank which, for the instant illustrative purpose, may be represented by capacitors C11–C13. In an ideal sense, the saturating reactors have the ability to change their impedance rapidly from a near open circuit to a near short circuit condition as saturation is carried out. The six reactors TX1–TX6, saturate in a sequence such that when one saturates, it drives another out of saturation. By observing that the saturation frequency rotates at line frequency, a unique pulse or pulses may be evolved from each reactor for every one-half cycle. The pulse height depends upon the characteristic of the reactor, i.e. the iron or copper in its core and consequent saturation density, while the width of these discrete pulses becomes a function of line frequency. Looking to FIG. 2, the build-up of such pulses evolving a sinewave configuration is schematically portrayed. In actuality, these pulses which compose the sinewave shape are never seen at the load due to the filtering action of the capacitors operatively associated with the saturating reactors.

Returning to FIG. 1, of the reactors within network 18, note that saturable reactors TX4, TX5, and TX6 are coupled with respective lines 20–22 directly to capacitors C11–C13. These reactors are configured as saturating reactors with a single secondary or choke configuration and additionally are coupled through respective lines 24–26 to reactors TX1, TX2 and TX3. The latter reactors are shown wired as transformers and are interconnected in zig-zag fashion, a technique conventionally used in forming grounding transformers as are used in utility functions to achieve a neutral output from three wires. Reactors TX1–TX3 additionally are shown to be coupled in series with reactors TX4–TX6. Note that this is one of several saturating core interconnections that would function herewith.

Looking to the connection of the saturating reactor network TX1–TX6 with capacitor bank C11–C13, note that such connection is direct through lines 20–22 and that the capacitors are associated with the latter lines in a delta formation structured by lines 28–30. Note that a wye connection would also function herewith. Thus associated with the reactor function of network 18, these capacitors serve as storage elements to maintain the reactors TX1–TX6 in oscillation, the reactors saturating and ringing with the capacitors to provide this function.

The insertion of energy from the input side 12 of the apparatus and system 10 is provided by an off-set arrangement accomplished by magnetic flux transfer. More particularly, energy is inserted into saturable reactors TX1–TX6 in magnetic fashion by corresponding primary windings TX1′–TX6′ connected in series with the outputs of respective input chokes TX7–TX9. FIG. 1 reveals that the output side of input choke TX7 is coupled through line 32 to primary winding TX4′ which is associated with reactor TX4, as well as primary winding TX1′ which, in turn, is associated with reactor TX1. Similarly, the output of input inductor TX8 is coupled through line 33 in series with the primary winding TX5′ associated with reactor TX5, as well as to primary winding TX2′ which is associated with reactor TX2. In like manner, the output of input inductor or choke TX9 is present at line 34 which is coupled in series with primary winding TX6′ which is operatively associated with reactor TX6 and with primary winding TX3′, the latter being operatively associated in primary winding fashion with the reactor TX3. Windings TX1′–TX3′ are interconnected in the earlier described zig-zag configuration. Faraday shields 36–38 are shown associated with the cores of respective windings TX4′–TX6′, while similar Faraday shields 40–42 are shown associated with the cores of primary windings TX1′–TX3′. These Faraday shields are shown coupled to a conventional ground or neutral position generally provided as a main ground busbar as represented at 44. The Faraday shields extend between primary and secondary windings and are connected to ground to lower interwinding capacitance and thus prevent the transfer of common mode line noise therebetween.

It is important to note that through the use of magnetic coupling of energy from the primary windings TX1′–TX6′ to the corresponding saturable reactor secondary windings TX1–TX6, a desired offsetting or isolation of the saturable reactor function 18 is achieved. Additionally, a series coupling is evolved which serves to improve performance of the overall device, inasmuch as it prevents the pass through of common mode noise. Further, the coupling technique is found helpful in stepping up or stepping down voltage and avoids dangerous voltage excursions in the event of catastrophic failure occasioned through broken wires or the like. Where such breakage occurs, the energy source is removed from the system to avoid damage. However, for performance in accordance with the invention, the step down function may be located in a circuit sense, downstream or upstream from the input inductors TX7–TX9 to achieve acceptable performance.

Regulator network 18, when operationally combined with the input inductors TX7–TX9 and the capacitor grouping C11–C13, serves to generate a three phase waveshape, however, the combination does not serve to generate a neutral or reference output. Consequently, a grounding transformer represented at 46 having input lines 48–50 coupled with respective lines 20–22 of network 18 is provided. Grounding transformer 46 is provided incorporating three coil structures identified at TX10 which combine with a single, three phase core to generate a neutral wire represented at 52. Note that the coils of transformer 46 are interconnected in the earlier described zig-zag fashion. The neutral output provided at output terminal 52 serves in conjunction with output terminals 54–56 of the system 10 which are coupled, respectively, with lines 20–22.

When operated in accordance with the structure thus far described, the system 10 provides a stable, high quality sinusoidal output. However, as described in the noted U.S. Pat. No. 4,305,033, the system on certain rarely occurring occasions will react to transient phenomena in a manner wherein it will assume a non-sinusoidal stable output state. This, of course, for essentially any occurrence, is unacceptable for applications to computer facilities and the like. The noted patent describes the discovery of the causes to the transient phenomena which occasions this stable non-sinusoidal operation, as well as the technique carried out for its prevention. Generally, it was determined that the transient phenomena encountered evidenced at least one very strong odd or even harmonic. By shorting these harmonics out at the output of the system or at any appropriate other position with tuned series traps, the unacceptable operational modes are avoided and the system achieves a reliability rendering it amenable to use in conjunction with modern computer facilities. The trap structures serve to force the energy representing unwanted harmonics back to fundamental as a form of energy reflection. For the instant embodiment, a series tuned trap configuration tuned to restrain even harmonics is represented by three series resonant circuits associated in delta configuration and incorporated within lines 56–58. Note in this regard that line 56 incorporates capacitor C21 and reactor TX11, while line 57 incorporates capacitor C22 and reactor TX12 and line 58 incorporates capacitor C23 and reactor TX13. Lines 56–58 are coupled across the output of the reactor network 18 as represented by the interconnection of line 58 with lines 20 and 22, the interconnection of line 56 with lines 20 and 21 and the interconnection of line 57 with lines 21 and 22.

In similar fashion, a second trap combination is provided which serves to restrain the development of odd harmonics and is incorporated within delta configuration defining lines 60–62. In this regard, a series resonant circuit is provided incorporating capacitor C31 and reactor TX14 within line 60; a series resonant circuit formed of capacitor C32 and reactor TX15 is provided within lines 61 and a series resonant circuit incorporating capacitor C33 and reactor TX16 is provided within line 62. This second trap combination which serves to drive odd harmonics to fundamental also is coupled across the output of reactor network 18, as represented by the connection of line 60 between lines 21 and combined lines 56 and 20; by the coupling of line 61 between line 22 and combined lines 57 and 21; and by the connection of line 62 between line 20 and combined line 58 and 22.

Generally, the odd and even tuned trap combinations will remain passive within the system, an ideal sinewave output being generated by the system which is immune from line input variations of considerable magnitude. Upon the occurrence of any transient phenomena, however, the resultant harmonics will be shorted out at the output of the system or any other appropriate position by the series tuned trap arrangement.

In accordance with the present invention, it has been discovered that the synthesizing or stabilizer apparatus thus far described can be altered to achieve significant improvements in the efficiency of operation thereof. The improved efficiency is developed by controlling the processed KVA that the regulators of network 18 experience for any given amount of actual throughput energy. This reduction is carried out by electing to position a predetermined amount of the capacitance otherwise provided from capacitors C11–C13 at the isolated primary winding input stages of the system 10, but electrically downstream of the input inductors TX7–TX9. In the practical construct of the circuit represented by FIG. 1, these resonant circuit capacitors are provided from a bank incorporating a parallel coupled plurality thereof. By connecting a certain ratio of capacitive value from this bank of capacitors to the primary side of system 10, an important efficiency improvement is achieved. FIG. 1 shows the location of capacitance value at the primary input side of the system 10 as capacitors C41–C43 respectively connected within lines 64–66. It should be understood that the capacitor symbols C41–C43 and C11–13 represent any predetermined number of capacitors of given capacitance value just as the corresponding representations are provided in conjunction with capacitors C11–C13. Lines 64–66 are arranged to interconnect the capacitors represented at C41–C43 in delta configuration and the connection thereof with the primary windings is provided by the connection of lines 66 and 64 through line 68 to input line 32; by the coupling of line 66 through lines 68 and 69 to respective input lines 32 and 34; and by the connection of line 65 through lines 69 and 70 to respective lines 34 and 33.

Thus the pulse saturation of the saturable regulator windings TX1–TX6 is carried out in conjunction with two banks of capacitors separated between the secondary windings TX1–TX6 and the primary windings TX1'–TX6'.

The effectiveness in improved efficiency achieved by this splitting of the capacitance between the input or primary isolation windings and the output or secondary saturable reactor winding components of system 10 can be demonstrated by comparing an efficiency related vector analysis of the current evolved for the case of the prior approach where all capacitors are retained in the secondary saturable reactor components of the system with the case of the instant invention where a split of capacitance values between the input and output functions of the system is provided. Looking to FIGS. 3A and 3B, vector diagrams are revealed showing a current analysis for previous power conditioner or synthesizer devices wherein capacitance is maintained with the saturable reactor output side of the synthesizer circuit. Development of these vector diagrams is initiated at the output side of the synthesizer and under selected typical operating parameters. In the latter regard, there is assumed to be no step down function, i.e. the apparatus performs, for example, as a 208 volt-to-208 volt type in conjunction with a 50 KW load and with a characteristic 91% efficiency. To determine relative efficiency, a KVA type of analysis need only look to current flow, inasmuch as the voltage level within the apparatus remains constant. Accordingly, assuming the above exemplary parameters, the load current in the regulator secondary (TX1–TX6) will be 139 amperes as represented at vector 72 in FIG. 3B.

Assuming 2160 microfarads of secondary capacitance, for the delta capacitor formation shown in FIG. 1, about 173 amperes is developed per leg and the current across the delta formation becomes about 300 amperes. Additional capacitance related current is concerned with the harmonic traps as described in FIG. 1, 42 amperes being associated with the even harmonic trap and 18 amperes being associated with the odd harmonics trap. The total capacitor current component of the regulator secondary represents the sum of the above currents, or 360 amperes. This value is represented at vector 73. The vector sum of vectors 72 and 73, represented at vector 74, represents current in the regulator secondary winding or the net resulting current and is about 386 amperes as represented at vector 74.

Looking now to FIG. 3A which concerns the input side of previous systems which are not coupled with a portion of the capacitance of the saturable reactor components, it initially is observed that there will exist about a 20° phase shift characteristic of synthesis from the input to the output. The lagging current of this input is represented at vector 76 and the value thereof in amperes may be computed by returning to the load current component at vector 72 in FIG. 3B and dividing that value by a typically encountered efficiency of 91%. Thus, by simply dividing the 139 ampere output value by 0.91, the value assignable to vector 76 may be 153 amperes.

By summing the values determined for vectors 74 and 76, a value for "summary" amperes representing current processed or experienced by the system is developed which equals 539 amperes. This value may be considered to be the predominant factor in determining the efficiency of operation of the regulator, and thus the system, since the regulators represent the major energy loss in the synthesizer system.

Referring to FIGS. 4A and 4B, by carrying out the same form of analysis with the split capacitance arrangement of the instant invention wherein, for example, the capacitance represented by capacitors C41–C43 is added to the input side of system 10, an improved efficiency system becomes apparent. Measurements have shown that the efficiency realized with the circuit illustrated in FIG. 1 is about 94%. Further, as described later herein, an ideal split of capacitance between the input and output sides of the synthesizer is in the respective ratio of 65% to 35%. Using those values of distribution, the output or secondary load current component represented by vector 78 of FIG. 4B again will be 139 amperes. Because only 35% of the capacitance values of the systhesizer circuit are assigned to the output or secondary windings in the instant exemplification, the capacitance related vector becomes lesser in extent and represents a 105 ampere value. Given the additive current from the odd and even traps of 18 and 42 amperes, respectively, the current as represented at vector 79 has a 165 ampere value as labeled. The resultant vector sum representing current in the regulator secondary as represented at vector 80 then has a value of 216 amperes.

Looking to FIG. 4A, and assuming the above-noted 94% efficiency, then the input or primary current at a 20° phase lag will represent the value 139 amperes divided by 94% which provides a value as labeled at vector 82 of 148 amperes. The corresponding 65% allocation of current to the capacitance values is represented in FIG. 1 at capacitors C41–C43 will, as represented at vector 83 have a value of 195 amperes as labeled. The corresponding active current at the input then may be represented by vector 84 and is computed, for example, using the law of cosines to have a value, as labeled, of 201 amperes.

The overall processed amperes or KVA utilization in the improved system then may be represented by the summation of the 201 ampere value of vector 84 and the 216 ampere value of vector 80 to provide a resultant value of 417 amperes. Comparing this value to the earlier 539 processed amperes derived by earlier systems shows that a significant improvement in processed KVA is achieved by the splitting of capacitance values between the input and output of system 10. In effect, a 23% reduction in current processed by the regulators is achieved for the same amount of performanced as was heretofore provided. Because of this improved efficiency, the regulators of the system may be designed at a scale of about 20% less than otherwise required with no degradation in performance of the system. This represents a significant savings in regulators as represented at circuit 10 as compared with prior devices.

A computer based study has been carried out to study current flow and resultant KVA performance generally following the analysis carried out in conjunction with FIGS. 4A and 4B. For the program, the same parameters were utilized, i.e. a regulator device having a 208 v input to 208 v output operating in conjunction with full load at 50 KVA. The splitting of capacitance between the primary or input side and secondary or output side of the system as described above was assigned in 5% steps and the total VA per regulator computed. The results of this investigation are set forth in Table I below and reveal that an optimum distribution between the input or primary side and output or secondary side of the system resides, respectively, at a ratio of 65/35. However, it may be observed that improved performance is achieved by moving any portion of the capacitance of the capacitor banks to the primary or input side of the system.

TABLE I

| Step (% at Input) | Input Primary Side capacitance (microfarads) | Output Secondary Side capacitance (microfarads) | Total va Per Regulator |
|---|---|---|---|
| 0 | 0 | 1976.24 | 13635.9 |
| 5 | 98.8119 | 1877.43 | 13170.4 |
| 10 | 197.624 | 1778.61 | 12742.6 |
| 15 | 296.436 | 1679.8 | 12355 |
| 20 | 395.248 | 1580.99 | 12009.1 |
| 25 | 494.06 | 1482.18 | 11705.4 |
| 30 | 592.872 | 1383.37 | 11443.4 |
| 35 | 691.684 | 1284.56 | 11221.8 |
| 40 | 790.496 | 1185.74 | 11038.7 |

TABLE I-continued

| Step (% at Input) | Input Primary Side capacitance (microfarads) | Output Secondary Side capacitance (microfarads) | Total va Per Regulator |
|---|---|---|---|
| 45 | 889.307 | 1086.93 | 10891.9 |
| 50 | 988.119 | 988.119 | 10779.3 |
| 55 | 1086.93 | 889.307 | 10699 |
| 60 | 1185.74 | 790.496 | 10649.6 |
| 65 | 1284.56 | 691.684 | 10630.2 |
| 70 | 1383.37 | 592.872 | 10640.5 |
| 75 | 1482.18 | 494.06 | 10680.9 |
| 80 | 1580.99 | 395.248 | 10752.5 |
| 85 | 1679.8 | 296.436 | 10856.8 |
| 90 | 1778.61 | 197.624 | 10995.9 |
| 95 | 1877.43 | 98.8119 | 11172.2 |
| 100 | 1976.24 | 0 | 11388.1 |

The discourse provided above in connection with FIG. 1 has revealed that the input inductors or chokes TX7–TX9 perform as a buffer at the source of power represented by the input lines 14–16. That utility derived line power has a unique sinewave shape and a unique voltage associated with it. Input chokes TX7–TX9 transfer the energy of the power source into the sinewave synthesizing components of the apparatus and system 10 without transferring thereinto the waveshape of the line source nor the voltage characteristics thereof. Generally, input inductors or chokes are not configured, for example, as transformers where energy is coupled from one winding to another, but function to impose an impedance to the a.c. components of the line input. The impedance derived is generated through structuring of required magnetic flux flow, generally through a predetermined gap. Because of the necessity for stability and the demands of typical computer installations, this gap is made varying such that the input inductors may accommodate for variations in load demand which permit progressively increasing numbers of flux paths to occur but under correspondingly progressing higher gap widths imposing associated lowering impedances.

Industry, for the most part, has developed input chokes or inductors utilizing a shell form of structure wherein thin sheets of a specialized iron or steel are stacked to form this outer shell which surrounds an opening or central portion which provides a cavity containing what are referred to as "windows". Within this cavity or within the windows is positioned an input coil which is coupled to the source of power and which will surround a center leg which similarly is fashioned of a stack of thin laminar sheets of specialized iron or steel. Between this center leg and the shell structure there is a predetermined gap configuration which in accordance with the teachings of U.S. Pat. No. 4,305,033, is fabricated in a stepped fashion to define gaps of very narrow dimension progressively extending to gaps of greater and greater dimension an may contain one or several separate gap positions.

The sheet material which forms both the shell and the center leg or legs is fashioned of a specialized metal which generally is a silicon containing steel. This material exhibits a high permeability to magnetic flux flow but does so in a directional sense. In this regard, the material can be made grain oriented and in very thin sheets such that magnetic flux may flow along the thin length thereof with least losses. For example, in the promotive direction of flux flow, typical flux losses for M6 grade steel are encountered to about 0.6 watts/lb. at 15K gauss under standard conditions. However, where flux entry into the thin sheet steel is perpendicular to the promotive direction but still represents an entry into a thin edge, then the flow will generate losses of about 1.8 watts per pound. Considering now the third geometric orientation of possible flux entry, where such entry is perpendicular to the flat face of such material, then the losses encountered could reach 100 watts/lb. or greater.

A laminar flux structure is utilized in the fabrication of both input inductors and transformers for the purpose of thwarting eddy currents. Where such eddy currents are generated, the resistance of the steel as confronting these currents causes the generation of heat and the loss of efficiency. Generally, the thickness of the laminar components of inductors is selected with respect to anticipated frequency of operation. For example, for conventionally encountered 60 Hz power sources, a laminar material of 0.014 inch thick is provided. The individual laminar silicon containing steel sheets additionally are coated with a very thin layer of silicon to render them mutually insulative.

As is apparent from the foregoing, the efficiency of an entire synthesizing system can be improved by improving the efficiency of the input inductors or chokes as at TX7–TX9. This can be carried out by avoiding the development of flux paths which extend into the high loss flat surfaces of the laminations forming the inductors. Where any such flat entries are encountered, losses encountered in the material elevate from the earlier described 0.6 watts/lb. to over 100 watts/lb. and intense heating in the area of such flux transfer occurs. For computer room utilization, not only must the aberrant flux paths be accommodated for by a larger structures for the input inductors, but also costs are encountered in the computer facility for removing the heat generated by such inefficiency as well as for paying the additional cost of power lost through lowered efficiencies.

Figure 5:
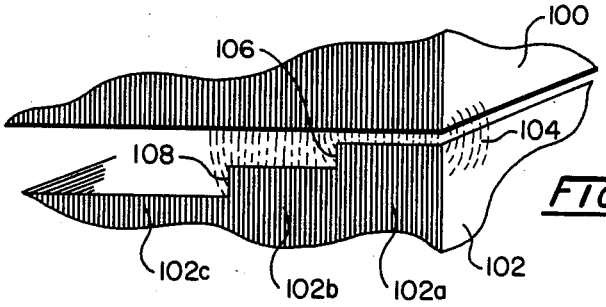
FIG. 5 is a partial perspective view of an input choke configured in accordance with the prior art.

Referring to FIG. 5, a partial perspective illustration of the variable gap core of a conventional choke or input inductor is revealed. The inductor components shown include portions of a laminar shell structure 100 fashioned as discussed above of a stacked array of silicon coated silicon containing steel sheets having a thickness, for example, of about 0.014 inch. A portion of the center leg of this input inductor is shown at 102 which is fabricated in conventional fashion. In this regard, a varying gap is produced by stacking an assemblage of varying lengths of the earlier-described very thin silicon containing steel sheets such that a narrowest gap is produced at the end of the center leg at 102*a*, a next larger gap is produced at 102*b* and a third and widest gap is produced at 102*c*. Accordingly, at lower loads, flux transfer initially will be caused to commence about the gap shown and defined by center leg components 102*a*. As more load is involved, the flux transfer then commences to move across the gap formed by components 102*b*. However, it is the nature of the flux transfer to assume paths more attractive to achieve transfer between the components 100 and 102. Thus a phenomenon known as "fringing" occurs wherein entry of the flux into the metal components is through the planar face portions as represented at 104. Where such entry occurs, as indicated above, the losses occurring in the steel components transition from the ideal edge-to-edge losses of 0.6 watts per pound to flat side losses at values over 100 watts per pound. As a consequence, not only is efficiency lowered but intense heating may be observed to occur in the localized areas. The fringing phenomena do not merely occur at the end portions of the conventional structures as shown, but also occur at the flat surfaces defined by the conventionally stepped gap as at 106 and 108. To the present, the losses occasioned by this conventional structure simply have been accepted by industry as an inherent attribute of input inductors.

In accordance with the present invention, the above-described formation of unwanted alternate flux paths has been substantially lowered through a center leg derived gap formation which serves, in effect, as a "flux chute" substantially controlling fringing phenomena and reducing heat loss as well as improving efficiency performance.

Figure 8:
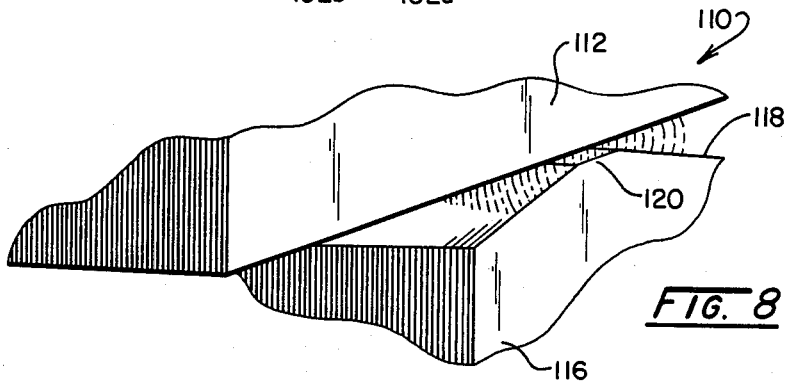
FIG. 8 is a partial perspective view of an input inductor configured according to the teachings of the present invention.
Figure 6:
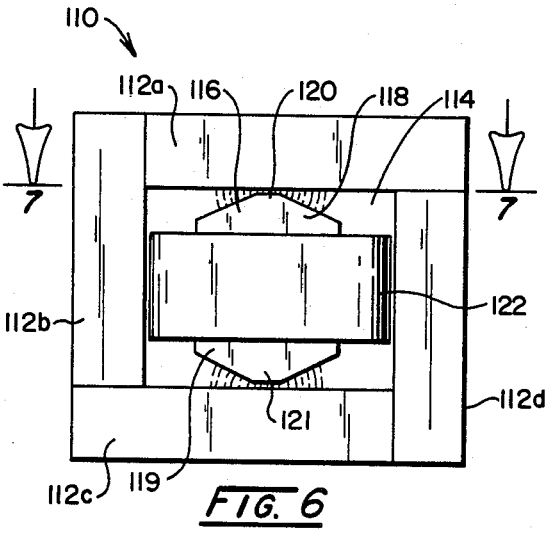
FIG. 6 is a front view showing in partial sectional form the input inductor of FIG. 6.
Figure 7:
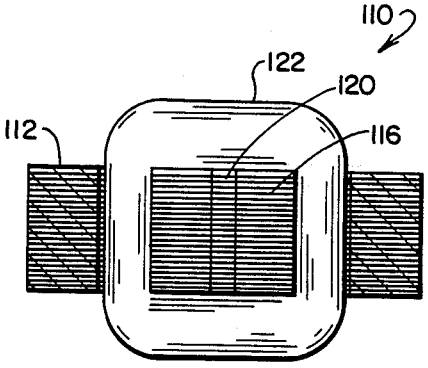
FIG. 7 is a top view of the inductor of FIG. 6.

Referring to FIG. 6, a front view of an input inductor or choke embodying the efficient gap structure of the invention is revealed generally at 110. The front view of choke 110 illustrates that the shell component thereof is formed of a stacked array of a rectangular flux permeable flux directing sheets or components 112*a*–112*d*. (See also FIG. 7.) This stacked arrangement is assembled in an alternating fashion such that the joints of the three components are alternately overlapped by succeeding sheet members. Within the cavity 114 formed by this stacked array of shell components there is provided a center leg 116 which similarly is fashioned of a plurality of substantially flat flux directing components or sheets which are configured in an elongate octagonal fashion to develop oppositely disposed edge regions 118 and 119. Edge regions 118 and 119 have respective flat narrowest gap defining flat apex portions respectively shown at 120 and 121. Thus structured, the narrowest gap for the choke 110 is established centrally of the outer shell structure which in the figures to follow is identified generally as 112. Symmetrically disposed from this apex portion as at 120 or 121, the gap then uniformly varies to the edge of the center leg which will have a width typically selected as twice that of the individual shell wall components 112*a*–112*d*, such an arrangement permitting appropriate magnetic circuits about the device 110. With the altered arrangement thus described, as additional loads are encountered, the flux path is constrained to expand in continuing edge-to-edge transfer into the varying portions of the gap as opposed to developing edge fringing and flat side losses as shown at 104 in FIG. 5. Thus, losses are minimized and heat development is minimized. The input coil to the structure 110 is shown at 122 surrounding the center leg 120. Only a minimal amount of fringing is permitted to occur with the structure thus shown as may be evidenced by examining the position of center leg 116 in FIG. 7. This end portion of the choke 110 is shown in FIG. 8. With the structure thus described, it further has been found that efficiencies can be improved by structuring the input inductor 110 such that it is somewhat deep in widthwise dimension. This arrangement emphasizes the edge-to-edge flux entry at regions 120 and 121 and renders the amount of fringing available as described in connection with FIG. 8 to a minimum with respect to the total amount of flux transfer across the variable gap.

Figure 9:
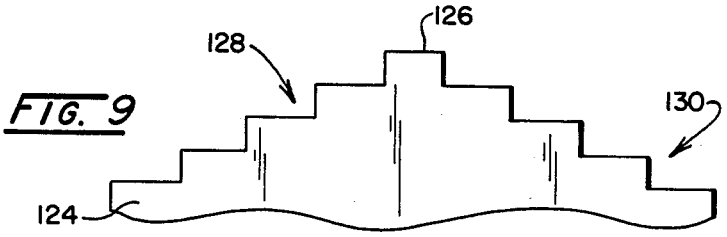
FIG. 9 is a partial sectional front view of an alternate structure for an input inductor according to the invention.

Experimentation has been carried out utilizing a center leg 116 structure wherein the apex 120 is maintained but the varying gap defined from that central apex is not linear but formed in stepwise fashion. Such an edge region configuration is shown in FIG. 9. Referring to that figure, it may be observed that this center leg 124 apex flat apex region is centrally positioned at 126 as before to define a gap of narrowest width. However, extending from apex region 126, stepping arrangements are made as shown generally at 128 and 130. Testing of such structures has shown an improvement in losses over prior art devices as described in connection with FIG. 5. However, such improvement is not to the extent of the linear edge region approach as described in connection with FIGS. 6–8. Additionally, fabrication of the devices of the latter figures is simpler and more practical than the stepped arrangement of FIG. 9. It is opined that the lower efficiency of the arrangement of FIG. 9 stems from flat side losses occasioned by the flat surfaces presented by the stepped structure.

In compiling the improvements in efficiency achieved through the combination of the improved input inductor described in connection with FIGS. 5–9 and with the rearrangement of the capacitance components as described in conjunction with FIGS. 4A and **4*b***, an overall efficiency improvement is made from a value of about 91% to a value of about 94%. By improving efficiency to this extent, the size of the line chokes as at TX7–TX9 is reduced by about 40%, while the size of the regulators as described in conjunction with components TX1–TX6 is reduced by an amount of about 30%. The net impact of these reductions on total system costs is found to amount to about 25%. Of course, these improvements do not further consider the savings in power costs both from the standpoint of removing loss generated heat and from the standpoint of improved throughput efficiency.

Since certain changes may be made in the above system and apparatus without departing from the scope of the invention herein involved, it is intended that all matter contained in the above description or shown in the accompanying drawings shall be interpreted as illustrative and not in a limiting sense.

I claim:

1. Apparatus for use with an a.c. source of variable voltage level and waveshape, and having a given frequency, for providing a regulated a.c. output to a load, comprising:

input choke means having a non-linear impedance characteristic connectable with said a.c. source for deriving an energy input substantially immune from said variable waveshape and voltage level;

primary winding means coupled with said input choke means for effecting energy transfer; and regulator means including saturable reactor means having secondary winding means inductively coupled in energy transfer relationship with said primary winding means, first capacitor means of first predetermined capacitance value coupled with said secondary winding means, and second capacitor means of second predetermined capacitance value coupled with said primary winding means, said first and second capacitor means effecting the oscillatory saturation of said reactor means at said given frequency and said first and second capacitance values being selected in accordance with a ratio minimizing the energy appearing across said saturable reactor means in the course of the oscillatory saturation thereof.

2. The apparatus of claim 1 in which said first and second capacitor values are selected having a said ratio of about 35/65.

3. The apparatus of claim 1 including:

series tuned trap means coupled with said regulator means for forcing energy representing odd and even harmonics generated by transient phenomena to fundamental as a form of energy reflection.

4. The apparatus of claim 1 in which said regulator means secondary winding means comprises:

three transformer configured pulse saturating reactors interconnected in zig-zag coupling; and three pulse saturating reactors in single secondary configuration coupled in series with said transformer configured reactors.

5. The apparatus of claim 4 in which said first capacitor means comprises delta coupled capacitors connected in series with said three pulse saturating reactors.

6. The apparatus of claim 5 including a grounding transformer, the primary windings of which are coupled across said a.c. output and which are associated with secondary windings thereof in zig-zag configuration for deriving a neutral output connectable with said load.

7. An input inductor for selectively treating a line source of power, comprising:

outer flux permeable shell means formed as a plurality of substantially flat first flux directing components arranged in face-to-face parallel adjacency to define an outwardly disposed flux path surmounting a central window region;

an input coil connectable with said source and disposed within said window region; and center leg means formed as a plurality of substantially flat second flux directing components extending within said coil to oppositely disposed edge regions defining varying gaps with corresponding opposite adjacent edges of said outer flux permeable shell means, said gaps having a narrowest extent substantially centrally positioned within said window and progressively increasing outwardly therefrom.

8. The input inductor of claim 7 wherein said center leg means edge regions are configured having a centrally disposed apex portion for deriving each said gap narrowest extent and are configured having substantially linear sloping edge portions extending therefrom.

9. The input inductor of claim 8 in which said central leg means edge region sloping edge portions extend symmetrically from said apex portion.

10. The input inductor of claim 8 in which said center leg means is structured having a generally octagonal profile.

11. The input inductor of claim 7 in which said center leg means second flux directing component flat surfaces are arranged in generally parallel relationship with said flux permeable shell means first flux directing flat surface.

12. The input inductor of claim 11 in which said flat second flux directing components of said center leg means are configured having substantially identical edge profiles.

13. The input inductor of claim 12 wherein said center leg means edge regions are configured having a centrally disposed apex portion for deriving each said gap narrowest extent and are configured having substantially linear, sloping edge portions extending therefrom.

14. An input choke for use with power line conditioning apparatus including a regulator comprising:

a flux permeable outer shell structured as a laminar, stacked assemblage of first discrete, parallel flat flux density components having adjacent inwardly disposed edges defining walls of a cavity of predetermined periphery including oppositely disposed spaced first and second walls;

a center leg structured as a laminar stacked assemblage of second discrete, parallel, flat flux density components positioned within said cavity and having first and second oppositely disposed edge regions extending toward respective said shell cavity first and second walls and defining varying gaps therewith, each said gap having a narrowest flux transfer portion generally centrally located with respect to an adjacent said wall and progressively increasing in extent outwardly from said portion; and an input coil connectable between said line and said regulator and disposed about said center leg.

15. The input choke of claim 14 wherein said center leg edge regions are configured having a centrally disposed, flat apex portion for deriving said gap narrowest flux transfer portion and are configured having substantially linearly sloping edge portions extending therefrom.

16. The input choke of claim 15 in which said center leg is structured having a generally octagonal profile.

17. The input choke of claim 14 in which said first discrete, parallel flat flux density components of said outer shell are generally parallel with said center leg second discrete, parallel flat flux directing components.

18. The input choke of claim 14 in which the said second discrete, parallel, flat flux directing components of said center leg are configured having substantially identical edge profiles.

19. The input choke of claim 18 in which said center leg is structured having a generally octagonal periphery.

20. The input choke of claim 19 wherein said center leg edge regions are configured having a centrally disposed, flat apex portion for deriving said gap narrowest flux transfer portion are configured having substantially linearly sloping edge portions extending therefrom.

21. A system for conditioning an a.c. source of power having a given frequency, for providing a regulated a.c. output to a load, comprising:

an input inductor including:

flux permeable shell means structured as a plurality of substantially flat first flux directing components arranged in stacked relationship to form a flux permeable path surmounting a window defining cavity having oppositely disposed spaced first and second walls;

center leg means structured as a plurality of substantially flat second flux directing components positioned within said cavity and having a first edge region extending toward said first wall and defining a varying gap therewith, said gap having a narrowest flux transfer portion substantially centrally located with respect to said first wall and progressively increasing in extent outwardly from said portion;

coil means connectable with said a.c. source, disposed about said center leg for deriving with said shell means and center leg means a treated energy input;

primary winding means coupled with said coil means to receive said treated energy input for effecting energy transfer; and regulator means including saturable reactor means having secondary winding means inductively coupled in energy transfer relationship with said primary winding means, first capacitor means of first predetermined capacitance value coupled with said secondary winding means, and second capacitor means of second predetermined capacitance value coupled with said primary winding means, said first and second capacitor means effecting the oscillatory saturation of said reactor means at said given frequency and said first and second capacitance values being selected in accordance with a ratio minimizing the energy appearing across said saturable reactor means in the course of the oscillatory saturation thereof.

22. The system of claim 21 in which said first and second capacitor values are selected having a said ratio of about 35/65.

23. Apparatus for use with an a.c. source of variable voltage level and waveshape, and having a given frequency, for providing a regulated a.c. output to a load, comprising:

input choke means having a non-linear impedance characteristic connectable with said a.c. source for deriving an energy input substantially immune from said variable waveshape and voltage level;

regulator means for receiving said energy input immune from said variable waveshape and voltage level, including polyphase saturable reactor means and first and second capacitor means having respective first and second predetermined capacitance values for effecting an oscillatory saturation thereof at said given frequency;

isolation means having an isolation winding inductively isolated from said regulator means for isolating said source from said load;

said second capacitor means being coupled with said isolating winding and said first and second capacitance values being selected in accordance with a ratio minimizing the energy appearing across said saturable reactor means in the course of the oscillatory saturation thereof; and filter means coupled with said regulator means for suppressing the generation of odd and even harmonics.

24. The apparatus of claim 23 in which said first and second capacitor values are selected having a said ratio of about 35/65.

25. The apparatus of claim 23 in which said input choke means comprises:

a flux permeable outer shell structured as a laminar, stacked assemblage of first discrete, parallel flat flux density components having adjacent inwardly disposed edges defining walls of a cavity of predetermined periphery including oppositely disposed spaced first and second walls;

a center leg structured as a laminar stacked assemblage of second, discrete, parallel, flat flux density components positioned within said cavity and having first and second oppositely disposed edge regions extending toward respective said shell cavity first and second walls and defining varying gaps therewith, each said gap having a narrowest flux transfer portion generally centrally located with respect to an adjacent said wall and progressively increasing in extent outwardly from said portion; and an input coil coupled between said source and said regulator means and disposed about said center leg.

26. The input choke of claim 25 wherein said center leg edge regions are configured having a centrally disposed, flat apex portion for deriving said gap narrowest flux transfer portion and are configured having substantially linearly sloping edge portions extending therefrom.

27. The input choke of claim 25 in which said center leg is structured having a generally octagonal profile.

28. The input choke of claim 25 in which:

said first discrete, parallel flat flux density components of said outer shell are generally parallel with said center leg second discrete, parallel flat flux directing components;

said second discrete, parallel, flat flux directing components of said center leg are configured having substantially identical edge profiles;

said center leg is structured having a generally octagonal periphery; and said center leg edge regions are configured having a centrally disposed, flat apex portion for deriving said gap narrowest flux transfer portion and are configured having substantially linearly sloping edge portions extending thereform.

29. The input inductor of claim 7 in which said flat first flux directing components of said shell means are each of elongate rectangular profile for assembly in end-to-end fashion to derive said central window region; and said center leg means is substantially symmetrically disposed within said central window region.

30. The input choke of claim 14 in which each said first discrete flat flux density component is of elongate rectangular profile dimensioned for mutual association in edge-to-edge fashion to define said central window region.

31. The input choke of claim 25 in which each said first discrete flat flux density component is of elongate rectangular profile dimensioned for mutual association in edge-to-edge fashion to define said central window region.

32. An input inductor for selectively treating a line source of power, comprising:

flux permeable shell means structured as a plurality of substantially flat first flux directing components arranged in stacked relationship to form a flux permeable path surrounding a window defining cavity having oppositely disposed spaced first and second walls;

center leg means structured as a plurality of substantially flat second flux directing components positioned within said cavity and having a first edge region extending toward said first wall and defining a varying gap therewith, said gap having a narrowest flux transfer portion substantially centrally located with respect to said first wall and progressively increasing in extent outwardly from said portion; and coil means connectible with said source and disposed about said center leg.

* * * * *